US008472851B2

(12) United States Patent
Takezawa

(10) Patent No.: US 8,472,851 B2
(45) Date of Patent: Jun. 25, 2013

(54) IMAGING FORMING APPARATUS AND METHOD OF CONTROLLING SAME

(75) Inventor: Satoru Takezawa, Nagareyama (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/546,181

(22) Filed: Jul. 11, 2012

(65) Prior Publication Data

US 2012/0275806 A1 Nov. 1, 2012

Related U.S. Application Data

(63) Continuation of application No. 13/361,294, filed on Jan. 30, 2012, now Pat. No. 8,244,165, which is a continuation of application No. 13/070,874, filed on Mar. 24, 2011, now Pat. No. 8,131,193, which is a continuation of application No. 12/123,568, filed on May 20, 2008, now Pat. No. 7,937,032.

(30) Foreign Application Priority Data

May 21, 2007 (JP) ..... 2007-134585

(51) Int. Cl.
*G03G 15/01* (2006.01)

(52) U.S. Cl.
USPC ..... 399/301

(58) Field of Classification Search
USPC ..... 399/301, 49
See application file for complete search history.

(56) References Cited

U.S. PATENT DOCUMENTS

| | | | |
|---|---|---|---|
| 6,014,542 A | 1/2000 | Hozumi et al. | |
| 7,937,032 B2 | 5/2011 | Takezawa | |
| 8,131,193 B2 | 3/2012 | Takezawa | |
| 8,244,165 B2 * | 8/2012 | Takezawa | 399/301 |
| 2001/0004425 A1 | 6/2001 | Shinohara et al. | |
| 2008/0089706 A1 | 4/2008 | Nakazato et al. | |
| 2008/0199193 A1 | 8/2008 | Nakazato et al. | |

FOREIGN PATENT DOCUMENTS

| | | |
|---|---|---|
| JP | 54-143144 A | 11/1979 |
| JP | 6-018796 A | 1/1994 |
| JP | 6-118735 A | 4/1994 |

(Continued)

OTHER PUBLICATIONS

Japanese Office Action for JP 2007-134585, mail date Apr. 13, 2012. Cited in parent U.S. Appl. No. 13/361,294.

(Continued)

*Primary Examiner* — Walter L Lindsay, Jr.
*Assistant Examiner* — Rodney Bonnette
(74) *Attorney, Agent, or Firm* — Rossi, Kimms & McDowell LLP

(57) ABSTRACT

An image forming apparatus has a function for adjusting the position at which a toner image is formed on a printing material, based upon amount of light reflected from a toner image that has been formed on an image carrier. The light-emitting unit emits light that irradiates the image carrier, and the detecting unit detects an amount of substrate-light reflected from the substrate of the image carrier. The determining unit determines whether the difference between the amount of substrate-light detected at a first point in time and the amount of substrate-light detected at a second point in time later than the first point in time is greater than a predetermined threshold value. The light-power control unit increases the amount of light in the light-emitting unit if the difference is greater than the predetermined threshold value.

13 Claims, 16 Drawing Sheets

FOREIGN PATENT DOCUMENTS

| | | | |
|---|---|---|---|
| JP | 6-301257 | A | 10/1994 |
| JP | 11194561 | A | 7/1999 |
| JP | 2000-081739 | A | 3/2000 |
| JP | 2000-338730 | A | 12/2000 |
| JP | 2003307902 | A | 10/2003 |
| JP | 2005-202110 | A | 7/2005 |

OTHER PUBLICATIONS

Japanese Office Action cited in Japanese counterpart application No. JP2007-134585, dated Mar. 4, 2013.

* cited by examiner

IMAGING FORMING APPARATUS AND METHOD OF CONTROLLING SAME

CROSS REFERENCE TO RELATED APPLICATION

This application is a continuation of and claims priority from U.S. patent application Ser. No. 13/361,294 filed Jan. 30, 2012, which is a continuation of U.S. patent application Ser. No. 13/070,874 filed Mar. 24, 2011 (now U.S. Pat. No. 8,131,193), which is a continuation of U.S. patent application Ser. No. 12/123,568, filed May 20, 2008 (now U.S. Pat. No. 7,937,032), which claims the benefit of Japanese Patent Application No. 2007-134585, filed on May 21, 2007. The entire contents of the applications cited in this paragraph are hereby incorporated herein by reference.

BACKGROUND OF THE INVENTION

1. Field of the Invention

The present invention relates to an image forming apparatus having a function for adjusting the position at which an image is formed, and to a method of controlling this apparatus.

2. Description of the Related Art

In general, it is desired that an image forming apparatus form an image at a desired position on a sheet of printing material. With a color image forming apparatus capable of forming an image of a plurality of colors, the color image is formed by superimposing images having a plurality of colors. In order to reduce color misregistration, therefore, it is desired that the positions at which the images of the colors are formed be made to coincide.

In order to reduce color misregistration in a conventional image forming apparatus, image formation position and color misregistration are corrected for by detecting a toner pattern that has been formed on a transfer belt using toner. Japanese Patent Laid-Open No. 6-18796 proposes a method of detecting the toner pattern by a CCD line sensor. Further, Japanese Patent Laid-Open No. 6-118735 proposes a method of detecting toner patterns of two or more colors by an optical sensor and then detecting any color misregistration of each color.

According to the examples of the prior art mentioned above, a specular-reflection-type optical sensor is used to detect the amount of light reflected from the substrate (background) of an intermediate transfer member such as a transfer belt and the amount of light reflected from a toner pattern, and the position of the pattern is detected based upon a signal obtained from the difference between the two amounts of light. This means that the difference between the amount of light reflected from the substrate and the amount of light reflected from the toner pattern must be sufficiently large.

FIGS. 17A to 17C are diagrams illustrating the transition of a difference between an amount A of light reflected from the substrate (signal level is high) and an amount C of light reflected from a toner pattern (signal level is low) in a print job involving a large volume of printing. FIG. 17A illustrates the output waveform of the amount of reflected light at the beginning of the large-volume print job, as well as a threshold value for detecting the toner pattern. If the intermediate transfer member has a high gloss, then, at least at the beginning of the large-volume print job, the amount of light reflected from the substrate is obtained and the difference between the amount of reflected light and the threshold value (namely A-B) is acquired to a satisfactory extent. This enables accurate detection of the position of the toner pattern.

However, since the intermediate transfer member becomes progressively contaminated with toner or the like as the number of images formed in the large-volume print job increases, the amount of light reflected from the substrate declines (FIG. 17B). If the contamination progresses, the amount of light reflected from the substrate and the threshold value become equal and erroneous detection of the toner pattern occurs (FIG. 17C). In other words, in accordance with FIG. 17C, a toner pattern exists in the interval in which the amount of reflected light is below the threshold value.

It should be noted that this problem does not readily arise in a case where a small-volume print job, in which the number of images formed is comparatively small, is repeated. The reason is that the intermediate transfer member usually is cleaned at the beginning and end of the print job. However, when several thousand images are formed in a single print job using an intermediate transfer member that is nearly new, the problem described above becomes conspicuous unless cleaning is performed during the printing process. Since executing cleaning results in temporary suspension of image formation, this leads to so-called "downtime" that lowers throughput. It is preferred, therefore, that cleaning not be performed during a print job to the extent possible.

SUMMARY OF THE INVENTION

Accordingly, the present invention seeks to solve at least one problem among this and other problems. For example, the present invention seeks to make it possible to detect the position of a toner pattern accurately even during execution of a large-volume print job that forms images on a large quantity of printing material at one time. Other problems will be understood from the entirety of the specification.

The present invention is applicable to an image forming apparatus, by way of example. The image forming apparatus has a function for adjusting the position at which a toner image is formed on a printing material, based upon amount of light reflected by a toner image that has been formed on an image carrier. The image forming apparatus includes a light-emitting unit, a detecting unit, a determining unit and a light-power control unit. The light-emitting unit emits light that irradiates the image carrier. The detecting unit detects an amount of substrate-light reflected from the substrate of the image carrier. The determining unit determines whether the difference between the amount of substrate-light detected at a first point in time and the amount of substrate-light detected at a second point in time later than the first point in time is greater than a predetermined threshold value. The light-power control unit increases the amount of light in the light-emitting unit if the difference is greater than the predetermined threshold value.

Further features of the present invention will become apparent from the following description of exemplary embodiments with reference to the attached drawings.

DESCRIPTION OF THE EMBODIMENTS

Embodiments of the present invention will be illustrated below. The individual embodiments described below will be useful in order to understand various concepts of the present invention, such as broader, intermediate and narrower concepts thereof. Further, the technical scope of the present invention is determined by the scope of the claims and is not limited by the individual embodiments set forth below.

[First Embodiment]

Figure 1:
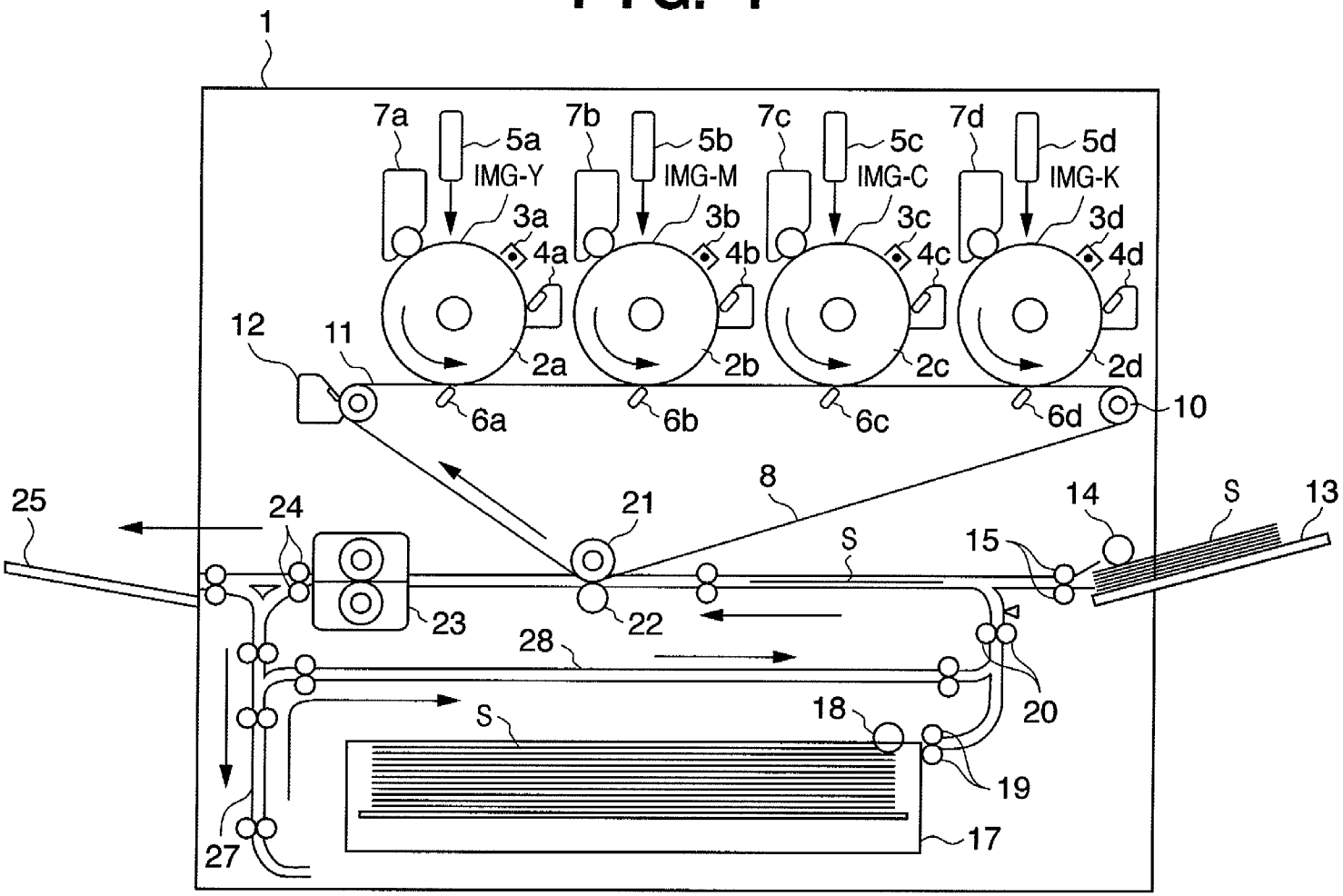
FIG. 1 is a sectional view illustrating the overall configuration of an image forming apparatus according to an embodiment of the present invention.

FIG. 1 is a sectional view illustrating the overall configuration of an image forming apparatus according to an embodiment of the present invention. Here the present invention will be described employing an electrophotographic color printer as an example of the image forming apparatus. However, the present invention is not limited solely to a printer. That is, the image forming apparatus may be implemented as a printing apparatus, copier, multifunction peripheral or facsimile machine.

A printer main body 1 is equipped with various units and devices that construct an image forming section. Photosensitive drums 2*a* to 2*d* are an example of image carriers that carry toners of respective ones of different colors. Charging devices 3*a* to 3*d* charge the surfaces of the corresponding photosensitive drums. Drum cleaners 4*a* to 4*d* remove toner remaining on the surfaces of the corresponding photosensitive drums. Laser scanning units 5*a* to 5*d* scan laser light across respective ones of the uniformly charged photosensitive drums to thereby form electrostatic latent images on the drums. Transfer blades 6*a* to 6*d* are blades for transferring (by primary transfer) the toner images, which have been formed on the corresponding photosensitive drums, to a transfer belt 8. Developing units 7*a* to 7*d* develop the electrostatic latent images by toner. The transfer belt 8 is an example of an intermediate transfer member and image carrier. The toner images of different colors are transferred from respective ones of the photosensitive drums to the transfer belt 8 so as to be superimposed on the belt. Rollers 10 and 11 are for supporting and circulating the transfer belt 8. A belt cleaner 12 removes toner remaining on the transfer belt 8.

A manual insertion tray 13 is a unit for accommodating printing paper S. The printing paper may also be referred to as a printing material, printing medium, paper, sheet, transfer material or transfer paper. Not only paper but also other materials such as fabric or resin may be employed as the material of the printing paper S. Pick-up rollers 14, 15 pick up and transport the printing paper S from the manual insertion tray 13. Registration rollers 16 are for adjusting the timing at which the transported printing paper S is transported to the transfer position. A paper-feed cassette 17 is a unit for accommodating printing paper S. Pick-up rollers 18, 19 pick up and transport the printing paper S from the paper-feed cassette 17. A vertical-path roller 20 is one roller for transporting the printing paper S from the paper-feed cassette 17. A rotating roller 21 is a roller for circulating the transfer belt 8. A secondary transfer roller 22 transfers (by secondary transfer) the toner image on the transfer belt 8 to the printing paper S. A fixing unit 23 applies heat and pressure to fix the toner image to the printing paper S. Discharge rollers 24 discharge the printing paper S to a drop tray 25.

When double-sided printing is performed, the printing paper S is guided to a double-sided turnover path 27 and transported to a double-sided path 28. The printing paper S that has traversed the double-sided path 28 passes by the vertical-path roller 20 again so that an image is formed, transferred and fixed to the second side of the printing paper in a manner similar to that of the first side.

Figure 2:
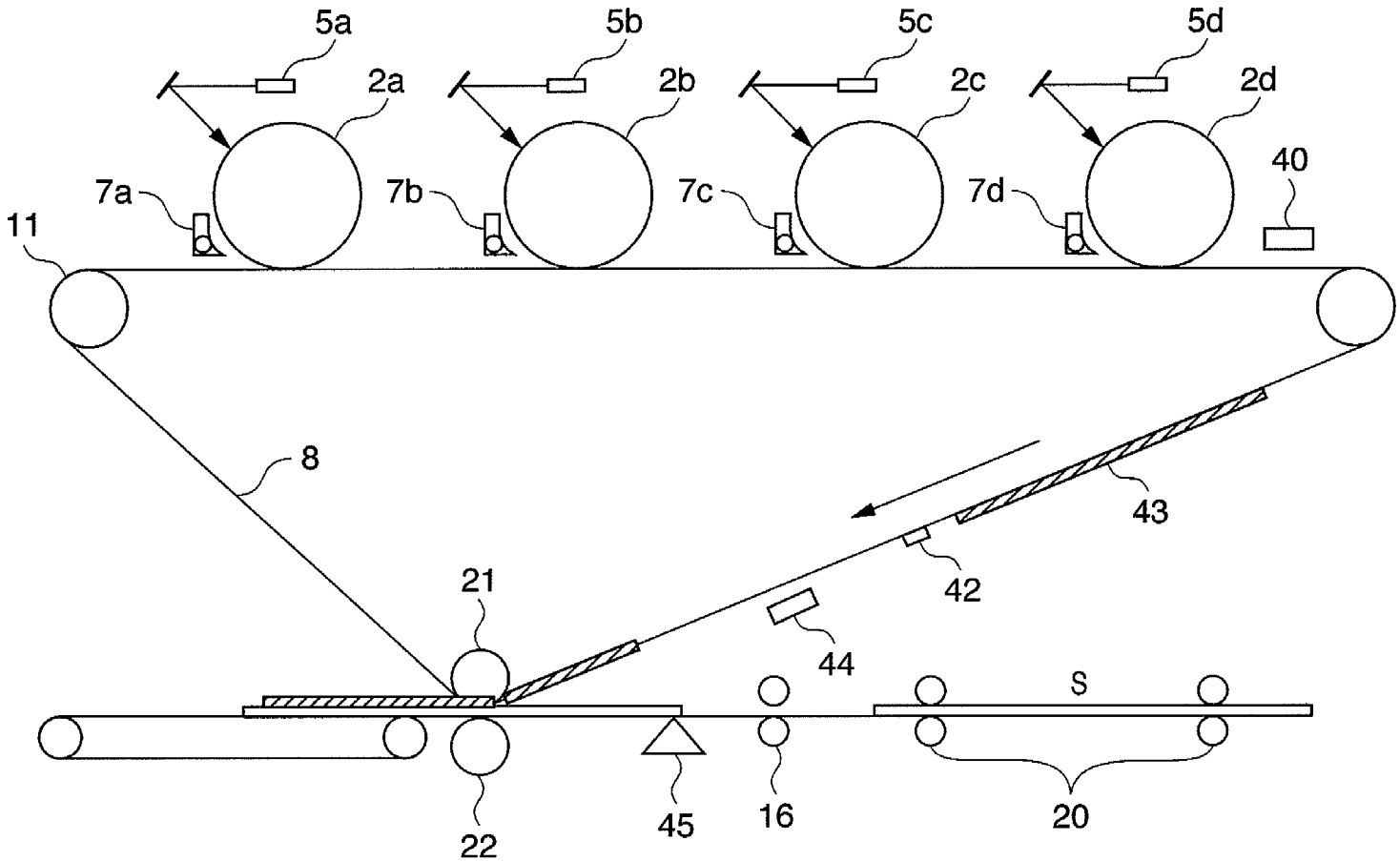
FIG. 2 is a diagram illustrating the positional relationship between an image at the time of image formation and a pattern for detecting the leading edge of the image, as well as the placement of optical sensor.

FIG. 2 is a diagram illustrating the positional relationship between an image at the time of image formation and a pattern for detecting the leading edge of the image, as well as the placement of optical sensors. Pattern sensors 40, 44 are reflective-type optical sensors for detecting a toner pattern that has been formed on the transfer belt 8. The pattern sensor 40 detects a toner pattern for correcting for color misregistration, by way of example. The pattern sensor 44 detects a toner pattern for correcting for a deviation in the image formation position (leading-edge position) with respect to the printing paper. It should be noted that the roles of the pattern sensors 40, 44 may be reversed.

A toner pattern 42 is one example of a toner image utilized in order to correct for image formation position and color misregistration. The toner pattern 42 may also be referred to as a toner patch, registration mark, patch pattern or patch image. The toner pattern 42 is formed a fixed distance ahead of an image 43 that is intended to be transferred to the printing paper. The toner pattern 42 is formed on the transfer belt 8 in an area other than an image area (namely in a so-called non-image area). Accordingly, the toner pattern 42 that has been formed in the non-image area is not transferred to the printing paper S.

The registration rollers 16 adjust the transport speed of the printing paper in accordance with the timing at which the toner pattern 42 has been detected by the pattern sensor 44 and the timing at which the leading edge of the printing paper has been detected by a paper leading-edge sensor 45. As a result, the positions of the leading edge of the image and the leading edge of the paper will coincide exactly with the secondary transfer position.

Figure 3:
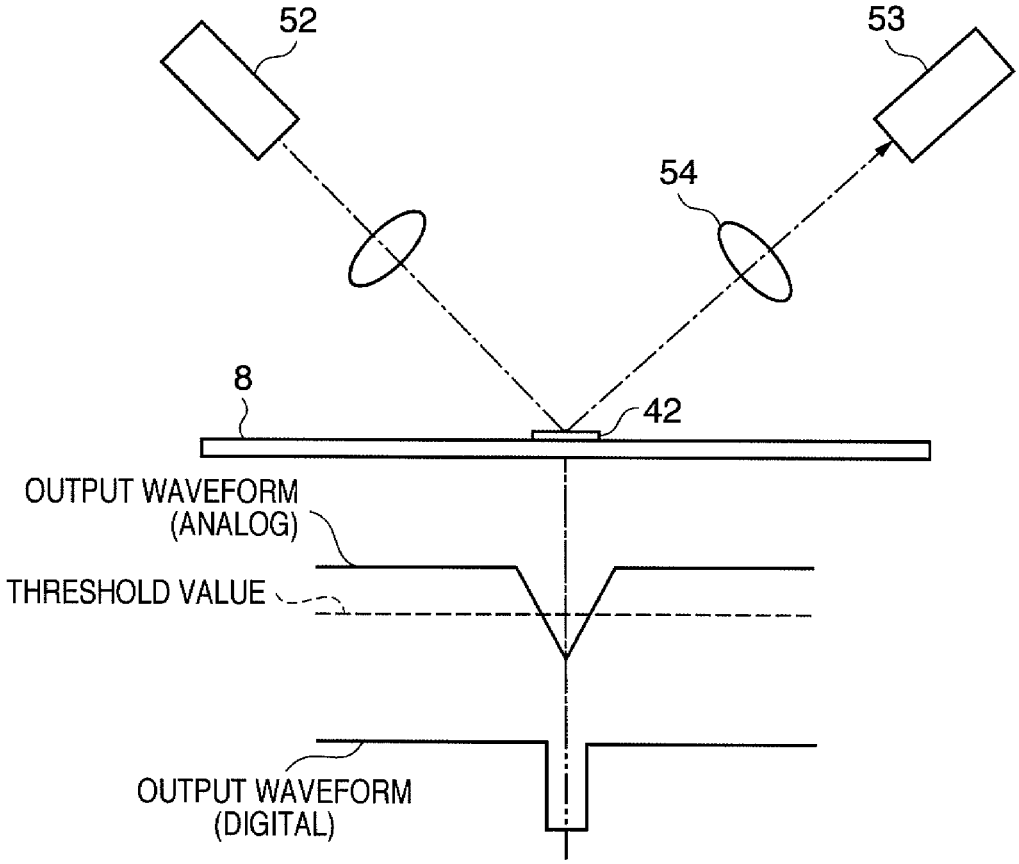
FIG. 3 is a diagram illustrating an example of a pattern sensor according to the embodiment.

FIG. 3 is a diagram illustrating an example of a pattern sensor according to this embodiment. The pattern sensor 40 has a light-emitting unit 52 and a light-receiving unit 53. Light emitted from the light-emitting unit 52 is reflected by the transfer belt 8 or toner pattern 42 and the reflected light impinges upon the light-receiving unit 53. The light-receiving unit 53 optoelectronically converts the reflected light and outputs a voltage that conforms to the amount of reflected light. The light-emitting unit 52 is one example of a light-receiving unit for emitting light that irradiates the image carrier. Further, the light-receiving unit 53 is one example of a detector for detecting amount of substrate-light, which is the amount of light reflected by the substrate of the image carrier, and amount of image light, which is the amount of light reflected by the toner image that has been formed on the image carrier. A lens 54 is provided between the light-receiving unit 53 and a detection subject such as the transfer belt 8. A lens may also be provided between the light-emitting unit 52 and the detection subject. These lenses are placed in order to condense light and enable the reflected light to be received efficiently.

FIG. 3 illustrates an analog output waveform obtained by reading the pattern, a digital output waveform corresponding to the analog output waveform, and a threshold value (dashed line). The output waveform is the waveform of the voltage that has been output from the sensor. The portion of the analog output waveform that exceeds the threshold value is logical "1" in the digital output waveform, and the portion of the analog output waveform that falls below the threshold value is logical "0" in the digital output waveform. It should be noted that the logic of the digital waveform may be reversed, i.e., the logic may be made "0" if the threshold value is exceeded and "1" if the threshold value is not exceeded. The description that follows will pertain to the former logic (namely in which the digital output waveform is at "1" when the threshold value is exceeded and at "0" when the threshold value is not exceeded).

Figure 4:
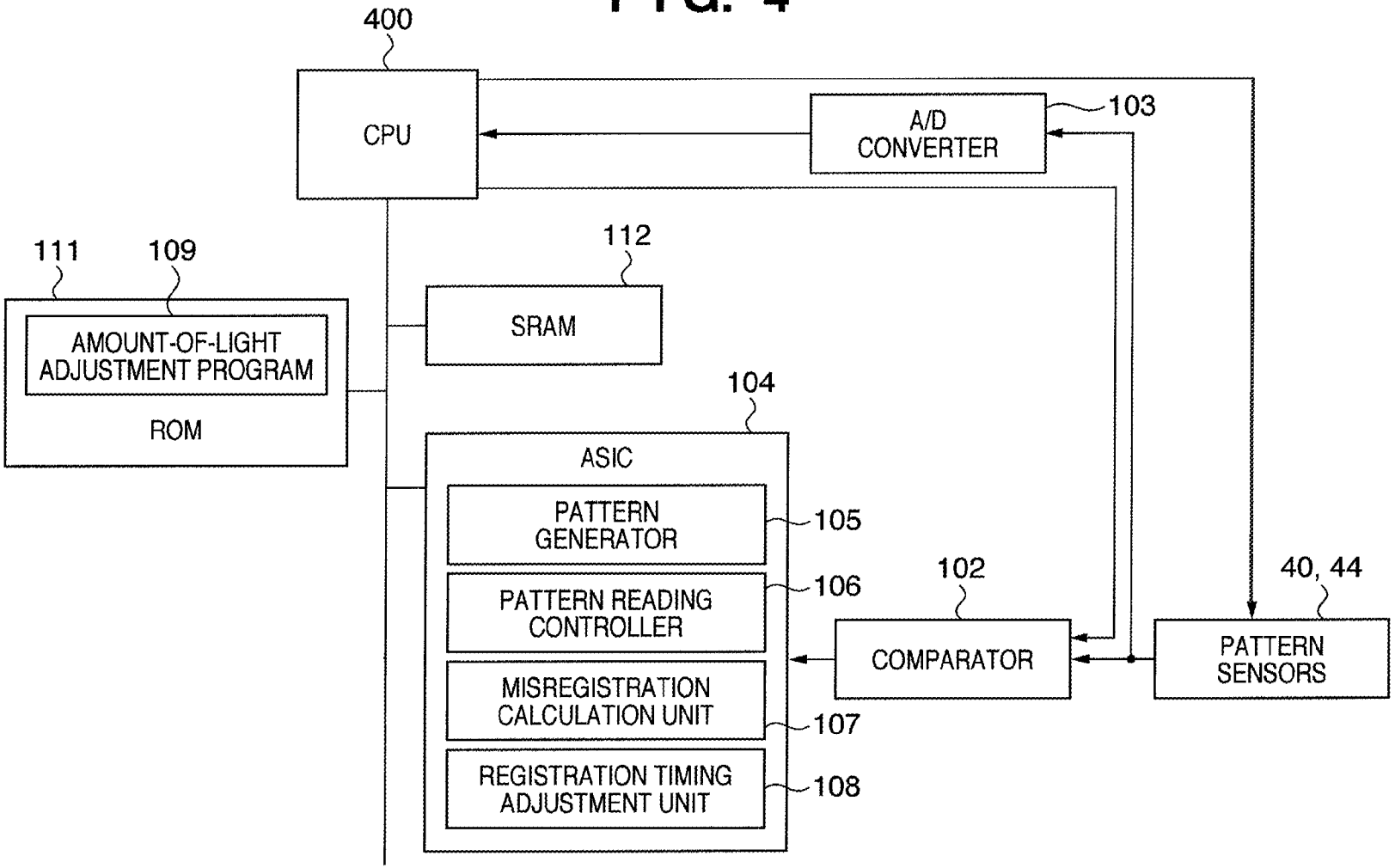
FIG. 4 is a block diagram illustrating a control unit for correcting for image position according to the embodiment.

FIG. 4 is a block diagram illustrating a control unit that corrects for image position according to this embodiment. A CPU 400 is a controller that performs the central role of the control unit that corrects for image position. The signals that have been output from the pattern sensors 40, 44 are input to a comparator 102 and A/D converter 103. The output signals are signals obtained by optoelectronically converting the amount of light reflected from the substrate of the transfer belt 8 and from the toner pattern on the transfer belt 8.

The comparator 102 compares the output signals from the pattern sensors with a threshold value that has been output from the CPU 400 and determines whether the output has exceeded the threshold value. If the threshold value is exceeded, the comparator 102 outputs "1". If the threshold value is not exceeded, the comparator 102 outputs "0". The A/D converter 103 converts the output signal (analog output voltage) from the pattern sensor to a digital signal and outputs the digital signal to the CPU 400.

An ASIC (application-specific integrated circuit) 104 has, e.g., a pattern generator 105, a pattern reading controller 106, a misregistration calculation unit 107 and a registration timing adjustment unit 108, etc. Some or all of the functions of these units may be implemented by the CPU 400 and a computer program that has been stored in a ROM 111. The pattern generator 105 generates image data representing the toner pattern 42. In a case where this image data has been stored in the ROM 111, etc., the pattern generator 105 may be eliminated. The pattern reading controller 106 reads the output signal from the pattern sensor and stores the read data temporarily. On the basis of read pattern data, the misregistration calculation unit 107 calculates the amount of deviation in the timings of the printing paper and image. The registration timing adjustment unit 108 controls the transport timing of the printing paper based upon the calculated deviation in timing.

The CPU 400 reads out and executes a computer program (e.g., a program for adjusting amount of light) 109 that has been stored in the ROM 111, thereby executing various processing according to the present invention. An SRAM 112 is a storage device for storing various data such as the value of drive current of the light-emitting unit 52 and threshold value decided by the CPU 400 in accordance with the program 109 for adjusting amount of light. It goes without saying that the amount of light emitted from the light-emitting unit 52 is controlled by this drive current.

At boot-up, etc., the CPU 400 adjusts the value of drive current of the light-emitting unit 52 in such a manner that the amount of light reflected from the substrate of the transfer belt 8 (the amount of substrate-light) will become the appropriate amount of reflected light. The amount of reflected light corresponds to the voltage of the output signal that is output from the light-receiving unit 53. The reason for adjusting the amount of light is that gloss or reflectivity of the substrate declines due to aging. It is preferred that the adjustment of amount of light be made under conditions in which a toner pattern has not been formed on the transfer belt 8. This is to eliminate the effects of the toner pattern.

As illustrated in FIG. 3, the voltage (output voltage) of the analog output waveform corresponding to the amount of substrate-light after the adjustment of amount of light is a stipulated value (e.g., 5 V). Further, as illustrated in FIG. 3, the threshold value is set in such a manner that the analog output voltage that prevails when the toner pattern is detected falls below the threshold value. That is, the CPU 400 sets the threshold value in such a manner that the toner pattern can be detected with good precision. It should be noted that the CPU 400 calculates the position of the centroid of the rising and falling edges of the digitized output waveform and stores the centroid position in the SRAM 112 as position data indicating the position of the toner pattern.

<Adjustment of Amount of Light at Initial Stage>

Figure 5:
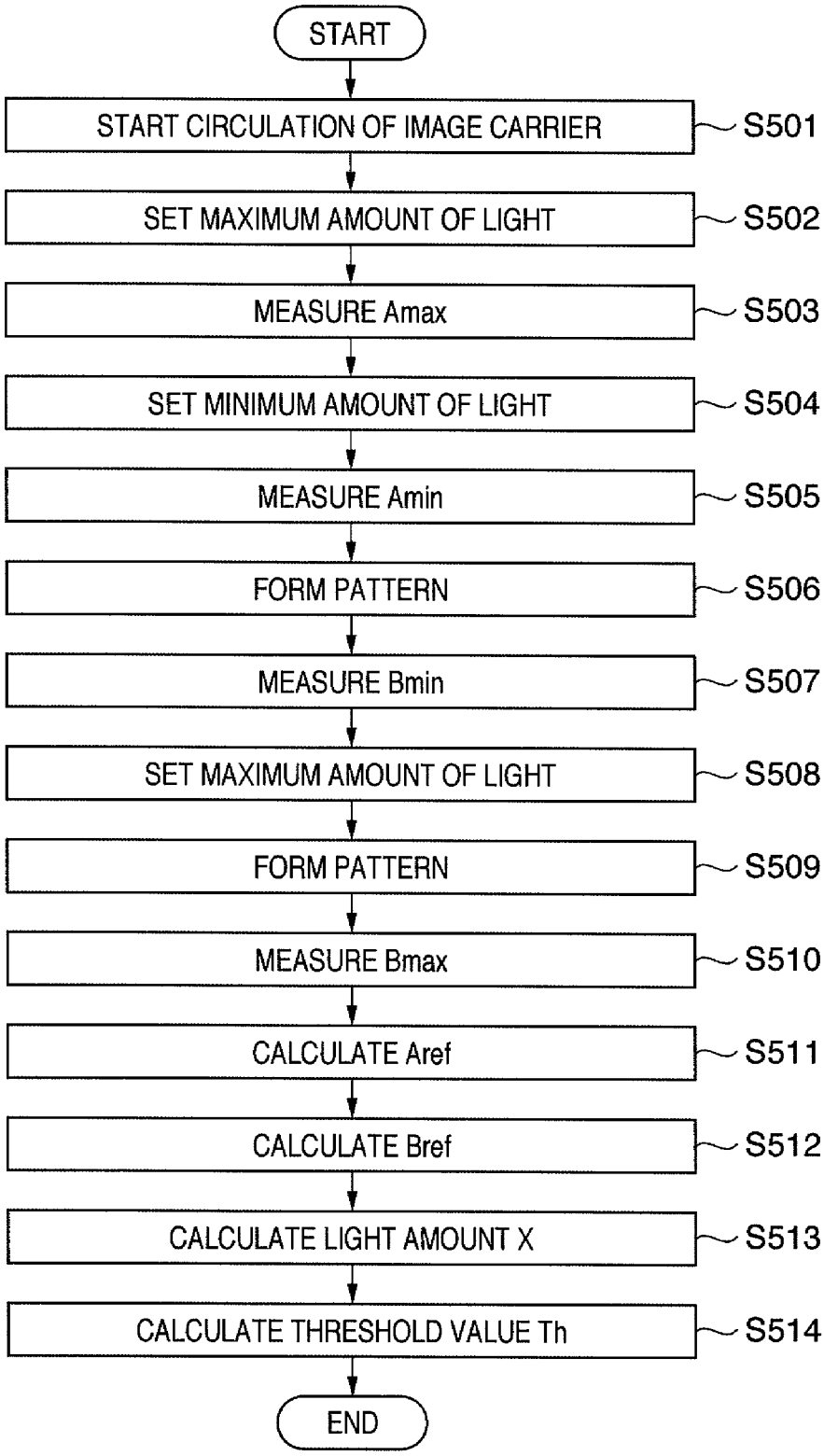
FIG. 5 is a flowchart illustrating an example of a sequence for initially adjusting amount of light according to the embodiment.
Figure 6:
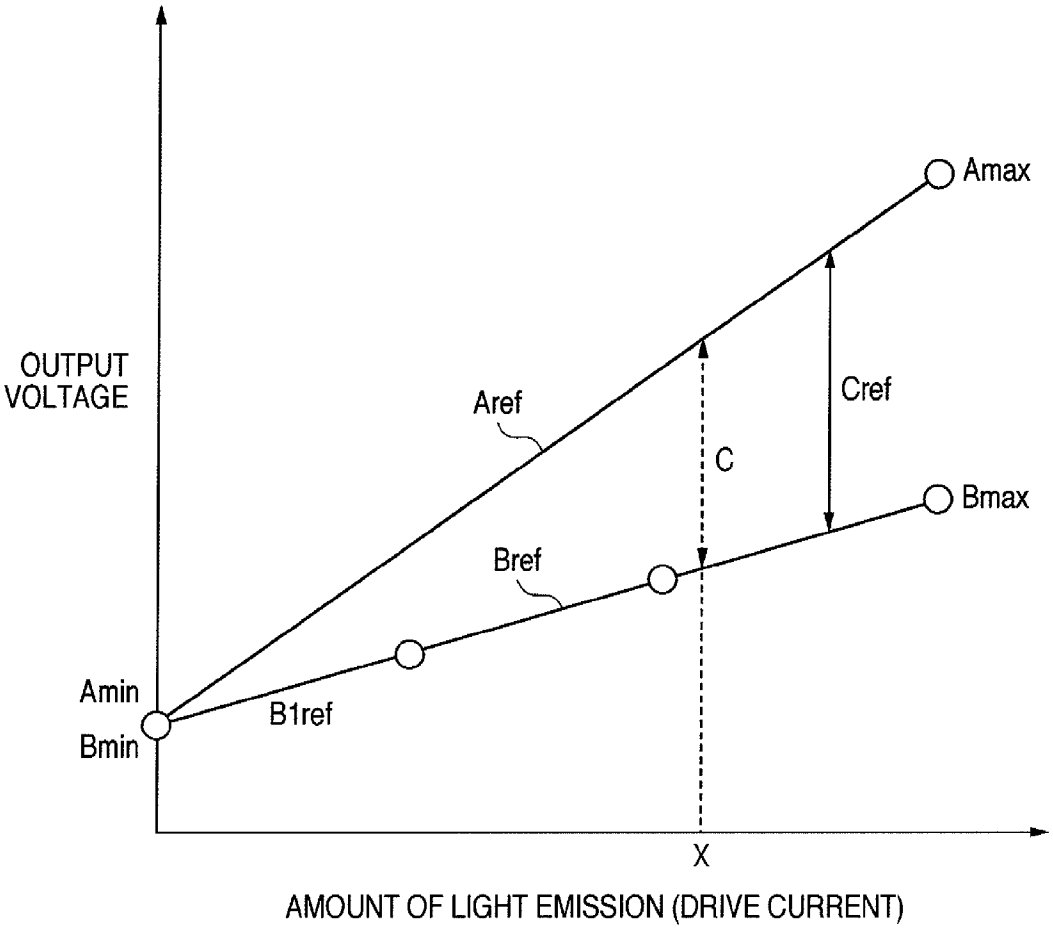
FIG. 6 is a graph illustrating the relationship between amount of light emission (drive current) of a light-emitting unit and output voltage from a light-receiving unit.

FIG. 5 is a flowchart illustrating an example of a sequence for initially adjusting amount of light according to this embodiment, and FIG. 6 is a graph illustrating the relationship between amount of light emission (drive current) of the light-emitting unit 52 and output voltage from the light-receiving unit 53. A first straight line Aref indicates the relationship between amount of light emission and output voltage relating to the amount of substrate-light. A second straight line Bref indicates the relationship between amount of light emission and output voltage relating to amount of reflected light (amount of image light) from the toner pattern. In the flowchart shown in FIG. 5, the first straight line Aref and the second straight line Bref are decided and a light-emission amount X that will prevail when a difference Cref between the two straight lines becomes a prescribed value C is decided.

At step S501, the CPU 400 sends a drive circuit (not shown) an instruction signal for starting circulation of the transfer belt 8. As a result, the drive motor connected to the rotating roller 21 rotates and the transfer belt 8 starts circulating. At step S502, the CPU 400 sets the amount of the light emission from the light-emitting unit 52 to the maximum value. Let Xmax represent this maximum value of the amount of the light emission. This maximum value is a value furnished with a certain degree of margin with respect to the rated current of the element constituting the light-emitting unit 52. For example, if the rated current is 100 mA, then the maximum value is 80 mA.

It should be noted that this amount of light need not necessarily be the rated current value and may be the maximum value of the range of the amounts of light assumed to be used or a predetermined stipulated value. At step S503, the CPU 400 measures the amount of substrate-light at this time. The measured amount of substrate-light is stored in the SRAM 112 as the maximum amount of substrate-light Amax. At step S504, the CPU 400 sets the amount of light emission of the light-emitting unit 52 to the minimum value. This minimum value may be zero. Alternatively, if the range of currents used by the sensor is known, the minimum value of this range may be used. Let Xmin represent this minimum value of the amount of light emission. This minimum amount of light may be the minimum value of the range of the amounts of light assumed to be used or a predetermined stipulated value. At step S505, the CPU 400 measures the amount of substrate-light at this time. The measured amount of substrate-light is stored in the SRAM 112 as the minimum amount of substrate-light Amin.

At step S506, the CPU 400 issues an instruction to the pattern generator 105 to form an amount-of-light adjustment toner pattern while maintaining the light amount Xmin as is. The pattern generator 105 generates the image data representing the amount-of-light adjustment pattern and sends the image data to the laser scanning units 5*a* to 5*d*.

It should be noted that although a single amount-of-light adjustment pattern is measured at light amounts Xmin, Xmax, the pattern may just as well be split into an amount-of-light adjustment pattern for the light amount Xmin and an amount-of-light adjustment pattern for the light amount Xmax.

At step S507, the CPU 400 measures the amount of light of the image, which is the light reflected from the amount-of-light adjustment pattern. The measured amount of light of the image is stored in the SRAM 112 as a minimum image light amount Bmin. At step S508, the CPU 400 sets the amount of light emission of the light-emitting unit 52 to the maximum value Xmax again. At step S509, the CPU 400 issues an instruction to the pattern generator 105 to form an amount-of-light adjustment pattern in a manner similar to that at step S506. The reason for forming the amount-of-light adjustment pattern again is that the amount-of-light adjustment pattern that was used to acquire the minimum image light amount Bmin has been wiped away by the belt cleaner 12. At step S510, the CPU 400 measures a maximum image light amount Bmax and stores it in the SRAM 112.

At step S511, the CPU 400 reads the maximum amount of substrate-light Amax and minimum amount of substrate-light Amin from the SRAM 112 and evaluates the formula representing the first straight line Aref. At step S512, the CPU 400 reads the maximum image light amount Bmax and minimum image light amount Bmin from the SRAM 112 and evaluates the formula representing the second straight line Bref. The difference between the first straight line Aref and the second straight line Bref is represented by Cref.

At step S513, the CPU 400 calculates a light amount X prevailing when the difference Cref is a predetermined value C. At step S514, the CPU 400 decides a threshold value Th used in order to detect the toner pattern and sets the threshold value in the comparator 102. It should be noted that the threshold value Th is set to a value that will enable the substrate and the toner pattern to be identified satisfactorily. For example, the value of a sum obtained by adding a prescribed value to the amount of light of the image at the light amount X decided at step S513 may be adopted as the threshold value Th. Alternatively, a value intermediate Aref and Bref at the light amount X decided at step S513 may be adopted as the threshold value Th.

Although the sequence for adjusting the amount of light at the initial stage has been described above, the present invention can also employ another sequence for adjusting the amount of light at the initial stage. The reason is that the present invention is not restricted by the content per se of the sequence for adjusting the amount of light at the initial stage. It will suffice if it is possible to set at least an amount of emitted light and a threshold value that will enable the detection of a toner pattern at boot-up.

<Sequence for Increasing Amount of Light in Large-Volume Print Job>

Figure 7:
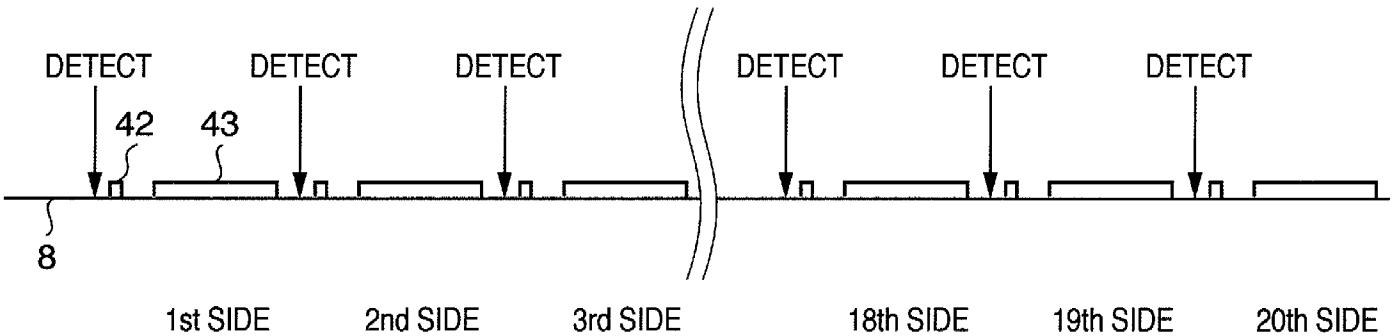
FIG. 7 illustrates timing at which amount of substrate-light is detected in a sequence for increasing amount of light.
Figure 8:
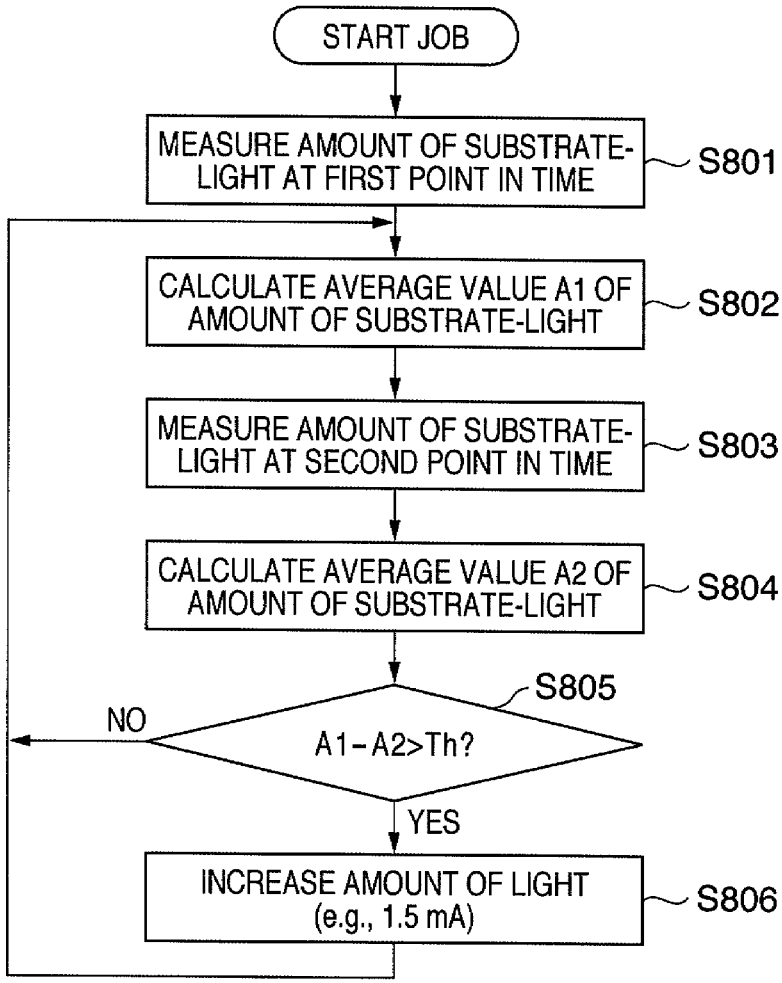
FIG. 8 is a flowchart illustrating an example of a sequence for increasing amount of light implemented during execution of a print job according to the embodiment.

FIG. 7 illustrates timing at which amount of substrate-light is detected in a sequence for increasing the amount of light. When a print job starts in this embodiment, a substrate portion on which neither the toner pattern 42 nor an image 43 to be transferred have been formed is irradiated with light and the amount of light reflected is detected. FIG. 8 is a flowchart illustrating an example of a sequence for increasing the amount of light implemented during execution of a print job according to this embodiment. When a print job is executed, the sequence for increasing the amount of light also is executed concurrently.

At step S801, the non-image area (i.e., the substrate) of the transfer belt 8 is irradiated with light from the light-emitting unit 52 and the amount of light reflected is received by the light-receiving unit 53, in response to which the CPU 400 measures the so-called amount of substrate-light. For example, measurement of the amount of substrate-light is executed one time whenever one image is formed. When double-sided image formation is performed, measurement is performed for each of the first and second sides of the printing paper. The data representing the measured amount of substrate-light is stored in the SRAM 112 whenever necessary.

At step S802, when the counted value of number of sheets of images formed reaches 20 sides, the CPU 400 reads 20 items of data representing the amount of substrate-light from the SRAM 112 and calculates the average value. Let this average value be an initial average value A1. It should be noted that the CPU 400 is one example of a counting unit for counting the number of sheets of images formed in one print job.

The initial average value A1 may be reset to zero whenever one print job ends. In this embodiment, the starting point in time of a print job introduced to the image forming apparatus (e.g., sides 0 to 20) is a first point in time. It goes without saying that the amount of substrate-light detected at boot-up of the image forming apparatus may be adopted as the amount of substrate-light at the first point in time. It should be noted that in this specification, "point in time" does not just mean a single point on the time axis but is also used as a term representing the interval (i.e., period) from one point to another point on the time axis.

At step S803, the CPU 400 detects the amount of substrate-light image by image until the number of sheets of images formed reaches a prescribed number (e.g., 500 sides). When the number of sheets of images formed reaches the prescribed number (e.g., 500 sides), the CPU 400 reads the data representing the amount of substrate-light from side 481 to side 500 out of the SRAM 112 and calculates an average value A2 at step S804. Accordingly, the CPU 400 is one example of a comparator that compares the counted number of sheets of images formed and a number stipulated in advance. Further, the point in time at which the number of sheets of images formed exceeds the stipulated number (e.g., 480 sides) is an example of a second point in time.

Thus, the average value A2 is one example of amount of substrate-light detected at a second point in time later than the first point in time. It should be noted that since data representing the amount of substrate-light from the $21^{st}$ side to the $480^{th}$ side is not utilized, this measurement may be omitted.

At step S805, the CPU 400 calculates the difference between the initial average value A1 and the average value A2 and determines whether the difference obtained has exceeded a prescribed threshold value Tv (e.g., 0.1 V). That is, the CPU 400 is one example of a determining unit for determining whether the difference between the amount of substrate-light detected at the first point in time and the amount of substrate-light detected at the second point in time has exceeded a predetermined threshold value.

If the threshold value is not exceeded, the CPU 400 resets the count to zero and control returns to step S803. On the other hand, if the difference exceeds the prescribed threshold value Tv, control proceeds to step S806, where the CPU 400 increases the amount of light emitted (the drive current of the light-emitting unit 52) by a prescribed increment (e.g., 1.5 mA). The prescribed increment is not limited to 1.5 mA. That is, it will suffice if the prescribed increment is decided in such a manner that the amount of substrate-light when the number of sheets of images formed reaches 500 sides becomes equal to the amount of substrate-light initially. For example, if the relationship between the above-mentioned difference (A1-A2) and the increment is expressed as a numerical formula empirically or logically, the CPU 400 can calculate the increment dynamically. Thus, the CPU 400 is one example of an amount-of-light controller for increasing the amount of light in the light-emitting unit in a case where the difference has exceeded a predetermined threshold value. Further, the CPU 400 is also one example of a deciding unit for deciding the increment in the amount of light in the light-emitting unit in accordance with the difference.

In accordance with this embodiment, the amount of light emitted by the light-emitting unit 52 is adjusted as necessary even during execution of a large-volume print job in which images are formed on a large quantity of printing material at one time. Even during execution of a large-volume print job, therefore, the position of a toner pattern can be detected with good precision.

It should be noted that the criterion as to whether the amount of light should be increased or not preferably is when a print job is started or when the image forming apparatus is booted up. The reason is that toner contamination, etc., of the transfer belt 8 ascribable to a large-quantity print job does not exert any effect at these times.

According to this embodiment, the amount of light emitted from the light-emitting unit 52 is increased on the precondition that the number of sheets of images formed in a print job for forming images continuously exceeds (or is equal to or greater than) a stipulated number determined in advance. That is, that a print job is a large-volume print job is the condition for increasing the amount of light. On the other hand, with regard to a small-volume print job in which the number of sheets of images formed is equal to or less than the stipulated value, control for increasing the amount of light is inhibited. The reason for this is that in the case of a small-volume print job, a problematic decline in amount of reflected light does not readily occur.

[Second Embodiment]

In the first embodiment, the difference between the amount of substrate-light at the first point in time and the amount of substrate-light at the second point in time is employed as the criterion as to whether the amount of light should be increased or not. In a second embodiment, the difference between (a) the difference between amount of substrate-light and amount of image-light at the first point in time and (b) the difference between amount of substrate-light and amount of image-light at the second point in time is employed as the criterion as to whether the amount of light should be increased or not. That is, whereas only a difference in amount of substrate-light is taken into account in the first embodiment, a difference in amount of image-light also is taken into account in the second embodiment.

Figure 9:
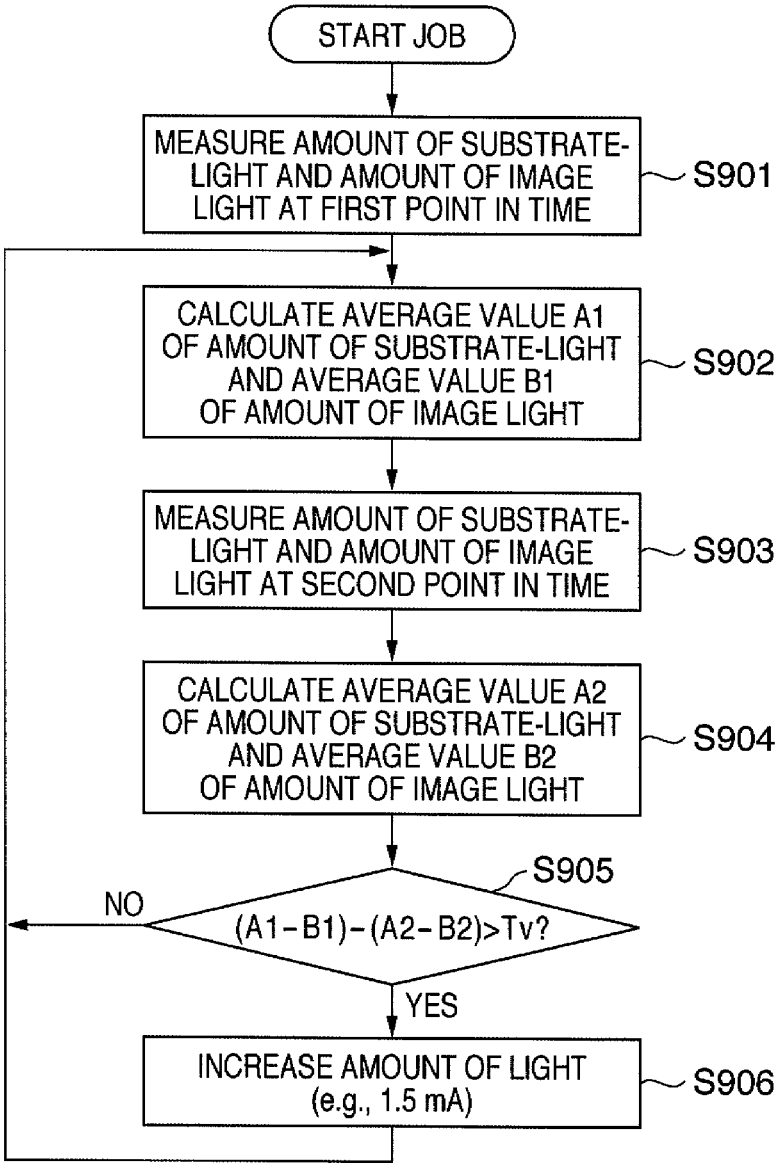
FIG. 9 is a flowchart illustrating an example of a sequence for increasing amount of light implemented during execution of a print job according to a second embodiment.

FIG. 9 is a flowchart illustrating an example of a sequence for increasing amount of light implemented during execution of a print job according to the second embodiment. When a print job is executed, this sequence for increasing the amount of light also is executed concurrently. At step S901, the substrate of the transfer belt 8 is irradiated with light from the light-emitting unit 52 and the amount of light reflected is received by the light-receiving unit 53, in response to which the CPU 400 measures the amount of substrate-light. The data representing the measured amount of substrate-light is stored in the SRAM 112 whenever necessary. Further, the toner pattern 42 that has been formed on the transfer belt 8 is irradiated with light from the light-emitting unit 52 and the amount of light reflected is received by the light-receiving unit 53, in response to which the CPU 400 measures the amount of image-light. The data representing the measured amount of image-light is stored in the SRAM 112 whenever necessary. Thus, the light-receiving unit 53 is one example of a detector for detecting the amount of substrate-light and amount of image-light.

At step S902, when the counted value of number of sheets of images formed reaches 20 sides, the CPU 400 reads 20 items of data representing the amount of substrate-light from the SRAM 112 and calculates the average value. Let this average value be an initial average value A1. Further, the CPU 400 reads 20 items of data representing the amount of image-light from the SRAM 112 and calculates the average value. Let this average value be an initial average value B1. These initial average values may be reset to zero whenever one print job ends.

At step S903, the CPU 400 measures the amount of substrate-light and the amount of image-light image by image until the number of sheets of images formed reaches a prescribed number (e.g., 500 sides). When the number of sheets of images formed reaches the prescribed number (e.g., 500 sides), the CPU 400 reads the data representing the amount of substrate-light from side 481 to side 500 out of the SRAM 112 and calculates an average value A2 at step S904. Similarly, the CPU 400 reads the data representing the amount of image-light from side 481 to side 500 out of the SRAM 112 and calculates an average value B2.

At step S905, the CPU 400 calculates the difference between (a) the difference between the initial average values A1 and B1 and (b) the difference between the average values A2 and B2 at elapse of formation of images of the stipulated number of sheets and determines whether the calculated difference has exceeded a prescribed threshold value Tv (e.g., 0.1 V). That is, the CPU 400 is one example of a determining unit for determining whether the difference between (a) the difference between the amount of substrate-light and amount of image-light at the first point in time and (b) the difference between the amount of substrate-light and amount of image-light at the second point in time has exceeded a predetermined threshold value.

If the threshold value is not exceeded, the CPU 400 resets the count to zero and control returns to step S903. On the other hand, if the difference exceeds the prescribed threshold value Tv, control proceeds to step S906, where the CPU 400 increases the amount of light emitted (the drive current of the light-emitting unit 52) by a prescribed increment (e.g., 1.5 mA). With regard to the increment, what was set forth in the first embodiment holds for the second embodiment as well.

In accordance with the second embodiment, the amount of light emitted by the light-emitting unit 52 is adjusted as necessary even during execution of a large-volume print job in which images are formed on a large quantity of printing material at one time. Even during execution of a large-volume print job, therefore, the position of a toner pattern can be detected with good precision.

[Third Embodiment]

In a third embodiment, whether or not amount of emitted light is increased is determined based upon a length of time from the rising edge to the falling edge of an output waveform produced when a toner pattern is detected.

Figure 10B:
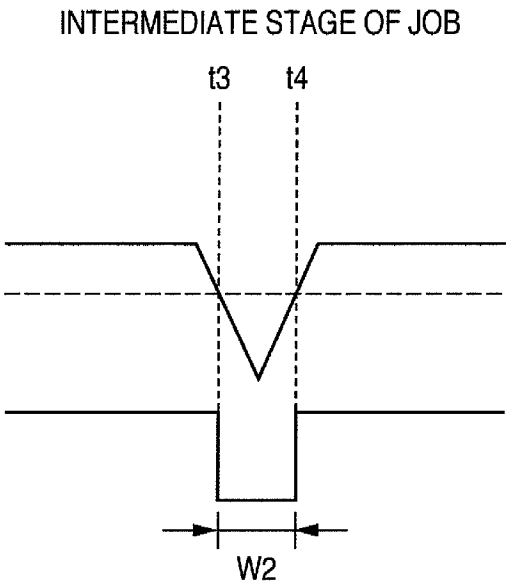
FIGS. 10A and 10B are diagrams illustrating examples of lengths of time from a falling edge to a rising edge of an output waveform produced when a toner image is detected.
Figure 10A:
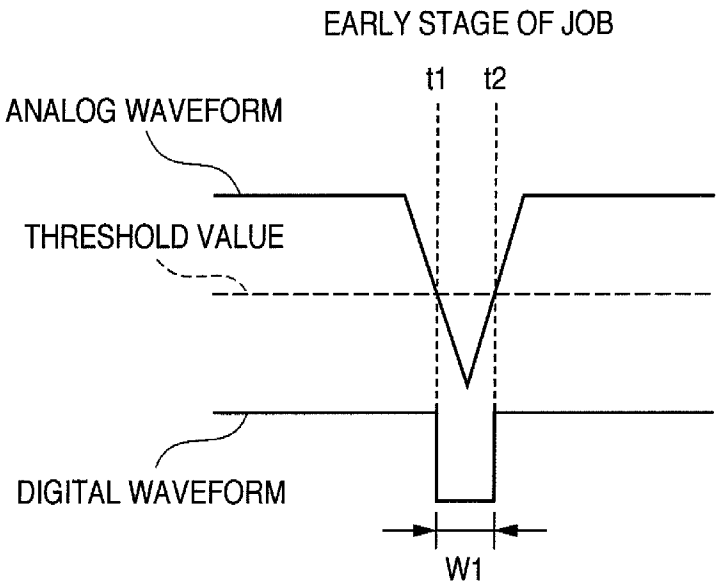

FIGS. 10A and 10B are diagrams illustrating examples of lengths of time from a falling edge to a rising edge of an output waveform produced when a toner image is detected. As will be understood from the drawings, an analog output voltage produced when a toner pattern is detected is binarized (digitized) in accordance with a threshold value. That is, the length of time is a time interval from a time t1 (t3) at which an initial amount of reflected light is below a specific threshold value to a time t2 (t4) at which a final amount of reflected light is below the threshold value. Let W1 represent the length of time at an initial stage (first point in time) of a print job, and let W2 represent the length of time at an intermediate or final stage (second point in time) of the print job. Thus, W1 is one example of a first length of time of an output waveform that is output from a detector when a toner image has been detected at a first point in time, and W2 is one example of a second length of time of an output waveform that is output from the detector when the toner image has been detected at a second point in time.

As will be understood from FIGS. 10A and 10B, the length of time at the initial stage and the length of time at the intermediate stage differ when a large-volume print job (e.g., a print job in which the number of sheets of images formed is several hundred) is executed. One cause of this phenomenon is that contamination due to toner adhering to the substrate of the transfer belt 8 is cumulative. Accordingly, the first length of time at the first point in time and the second length of time at the second point in time are measured and whether or not the difference between these two lengths of time exceeds a predetermined threshold value can be employed as a criterion as to whether or not the amount of light emitted should be increased.

Figure 11:
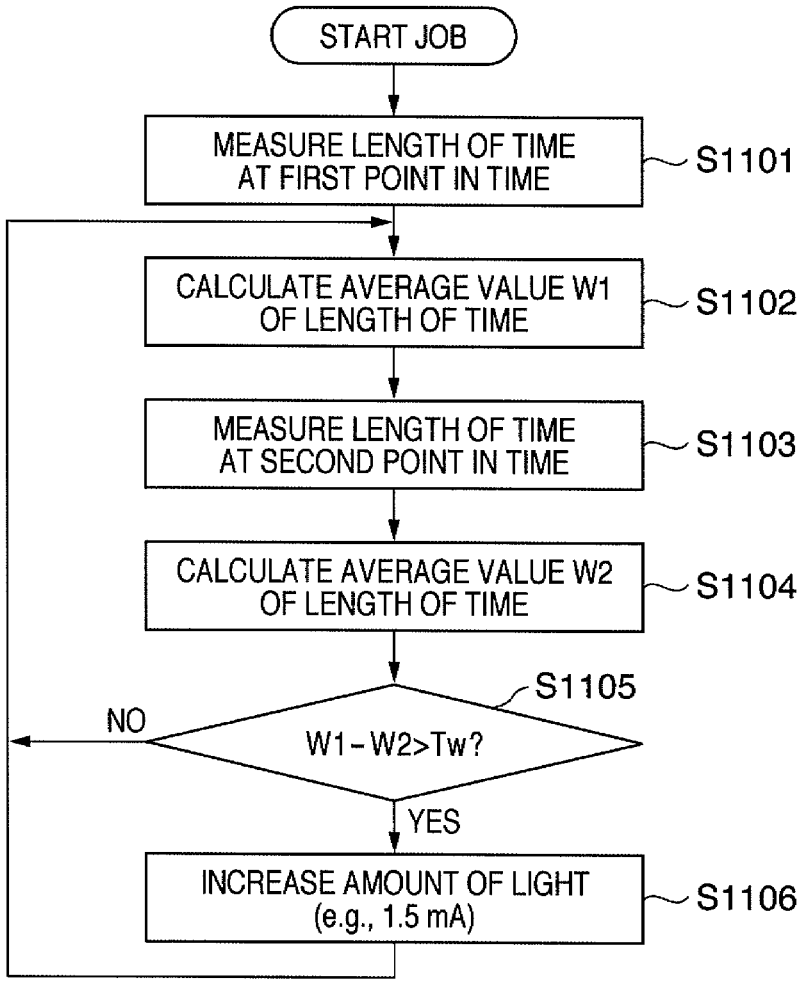
FIG. 11 is a flowchart illustrating an example of a sequence for increasing amount of light implemented during execution of a print job according to a third embodiment.

FIG. 11 is a flowchart illustrating an example of a sequence for increasing amount of light implemented during execution of a print job according to a third embodiment. When a print job is executed, the sequence for increasing the amount of light also is executed concurrently. At step S1101, the CPU 400 measures the length of time at the first point in time (e.g., from side 0 to side 20, which is the starting point in time of the print job). By way of example, the substrate of the transfer belt 8 and the toner pattern that has been formed on the transfer belt 8 are irradiated with light from the light-emitting unit 52 and the amount of light reflected is received by the light-receiving unit 53, in response to which the CPU 400 measures the amount of light reflected. The CPU 400 starts measuring time when the amount of light reflected falls below the prescribed threshold value, and stops measuring time when the amount of light reflected exceeds the prescribed threshold value. This measured time interval is stored in the SRAM 112 as the length of time at the first point in time. For example, 20 lengths of time corresponding to side 0 to side 20 are stored.

At step S1102, when the counted value of number of sheets of images formed reaches 20 sides, the CPU 400 reads the 20 lengths of time from the SRAM 112 and calculates the average value. Let this average value be an initial average value W1. This initial average value may be reset to zero whenever one print job ends. Thus, the CPU 400 is one example of a measuring unit for measuring the first length of time (initial average value W1), which is the length of time at the first point in time.

At step S1103, the CPU 400 measures the length of time image by image until the number of sheets of images formed reaches a prescribed number (e.g., 500 sides). When the number of sheets of images formed reaches the prescribed number (e.g., 500 sides), the CPU 400 reads the data representing the lengths of time from side 481 to side 500 out of the SRAM 112 and calculates the average value at step S1104. This average value is adopted as the intermediate average value W2. Thus, the CPU 400 is one example of a measuring unit for measuring the second length of time (intermediate average value W2), which is the length of time at the second point in time.

At step S1105, the CPU 400 calculates the difference between the initial average value W1 and the intermediate average value W2 and determines whether the difference has exceeded a prescribed threshold value Tw (e.g., 0.1 V). That is, the CPU 400 is one example of a determining unit for determining whether the difference between the initial average value W1, which is the first length of time, and the intermediate average value W2, which is the second length of time, has exceeded a predetermined threshold value.

If the threshold value is not exceeded, the CPU 400 resets the count to zero and control returns to step S1103. On the other hand, if the difference exceeds the prescribed threshold value Tw, control proceeds to step S1106, where the CPU 400 increases the amount of light emitted (the drive current of the light-emitting unit 52) by a prescribed increment (e.g., 1.5 mA). With regard to the increment, what was set forth in the first embodiment holds for the second embodiment as well.

Figure 12:
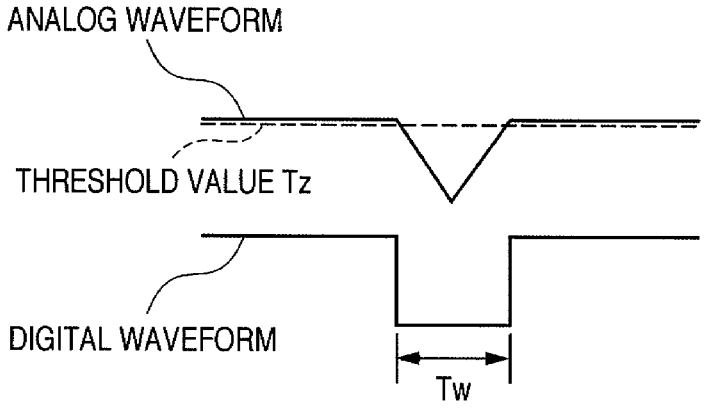
FIG. 12 is a diagram for describing an example of a threshold value.

FIG. 12 is a diagram for describing an example of the threshold value Tw. Preferably, the threshold value Tw is made smaller than a length of time measured when the amount of reflected light has become equal to a threshold value Tz. This is to assure some margin. For example, if W1 is 5.0 ms and the length of time measured when the amount of reflected light has become equal to a threshold value Tz is 10.0 ms, then Tw is made 8.0 ms. On the other hand, if an increase in amount of light is necessary more frequently, it will suffice to set Tw to 5.5 ms. These specific numerical values are merely illustrations.

In accordance with the third embodiment, the amount of light emitted by the light-emitting unit 52 is adjusted as necessary even during execution of a large-volume print job in which images are formed on a large quantity of printing material at one time. Even during execution of a large-volume print job, therefore, the position of a toner pattern can be detected with good precision.

[Fourth Embodiment]

In the first to third embodiments, the first point in time has been described as the initial stage of a print job. However, this does not impose a limitation upon the present invention. That is, the first point in time may be boot-up time of the image forming apparatus.

Figure 13:
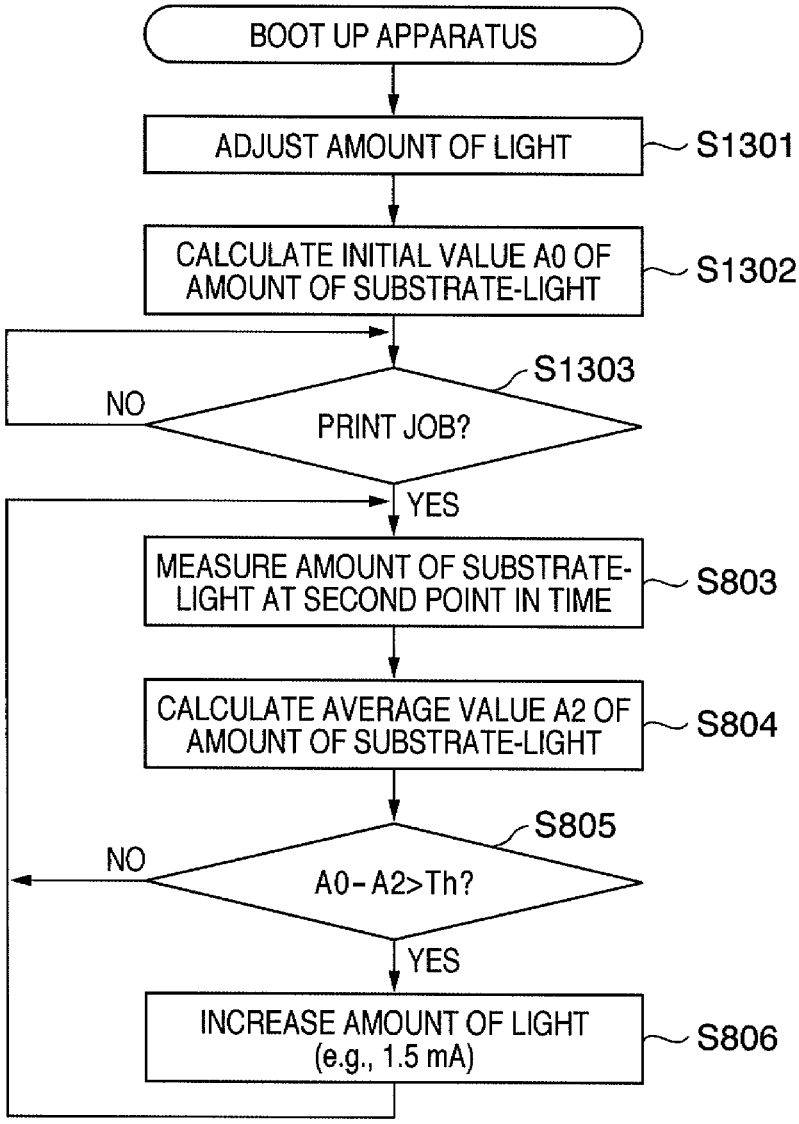
FIG. 13 is a flowchart illustrating an example of a sequence for increasing amount of light implemented during execution of a print job according to a fourth embodiment.

FIG. 13 is a flowchart illustrating an example of a sequence for increasing amount of light implemented during execution of a print job according to a fourth embodiment. Here the sequence for increasing the amount of light is started from boot-up time of the image forming apparatus. At step S1301, the CPU 400 executes the above-described adjustment of amount of light in the initial stage. As a result, an initial light-emission amount X is decided. Further, the CPU 400 calculates an initial value A0 of amount of substrate-light in the initial light-emission amount X from the above-mentioned first straight line Aref. The initial value A0 of amount of substrate-light is stored in the SRAM 112 instead of the above-mentioned initial average value A1 of amount of substrate-light.

At step s1303, the CPU 400 determines whether a print job has been introduced. If a print job has been introduced, the above-described processing of steps S803 to S806 is executed. It goes without saying that the initial value A0 of amount of substrate-light is used instead of the initial average value A1 of amount of substrate-light.

In accordance with the fourth embodiment, the amount of light emitted by the light-emitting unit 52 is adjusted as necessary even during execution of a large-volume print job in which images are formed on a large quantity of printing material at one time. Even during execution of a large-volume print job, therefore, the position of a toner pattern can be detected with good precision.

The technical concept of the fourth embodiment is also applicable to the second and third embodiments described above. If applied to the second embodiment, steps S901 and S902 are replaced by steps S1301 to S1303. It goes without saying that the amount of light of the image also is measured at step S1301 and the initial value B0 of the amount of image-light is calculated at step S1302. The initial value B0 of the amount of image-light is used instead of the initial average value B1 of the amount of image-light. If applied to the third embodiment, steps S1101 and S1102 are replaced by steps S1301 to S1303. It goes without saying that the initial value W0 of length of time is calculated at step S1302. The initial value W0 of length of time is used instead of the initial average value W1 of length of time.

[Fifth Embodiment]

As one example in the first to fourth embodiments, whether or not amount of light is increased is decided in accordance with whether or not a threshold value has been exceeded or not (S805, S905, S1105). In a fifth embodiment, use of a plurality of threshold values is proposed. That is, the increment in amount of light in the light-emitting unit 52 is decided in accordance with the size of the difference.

Figure 14:
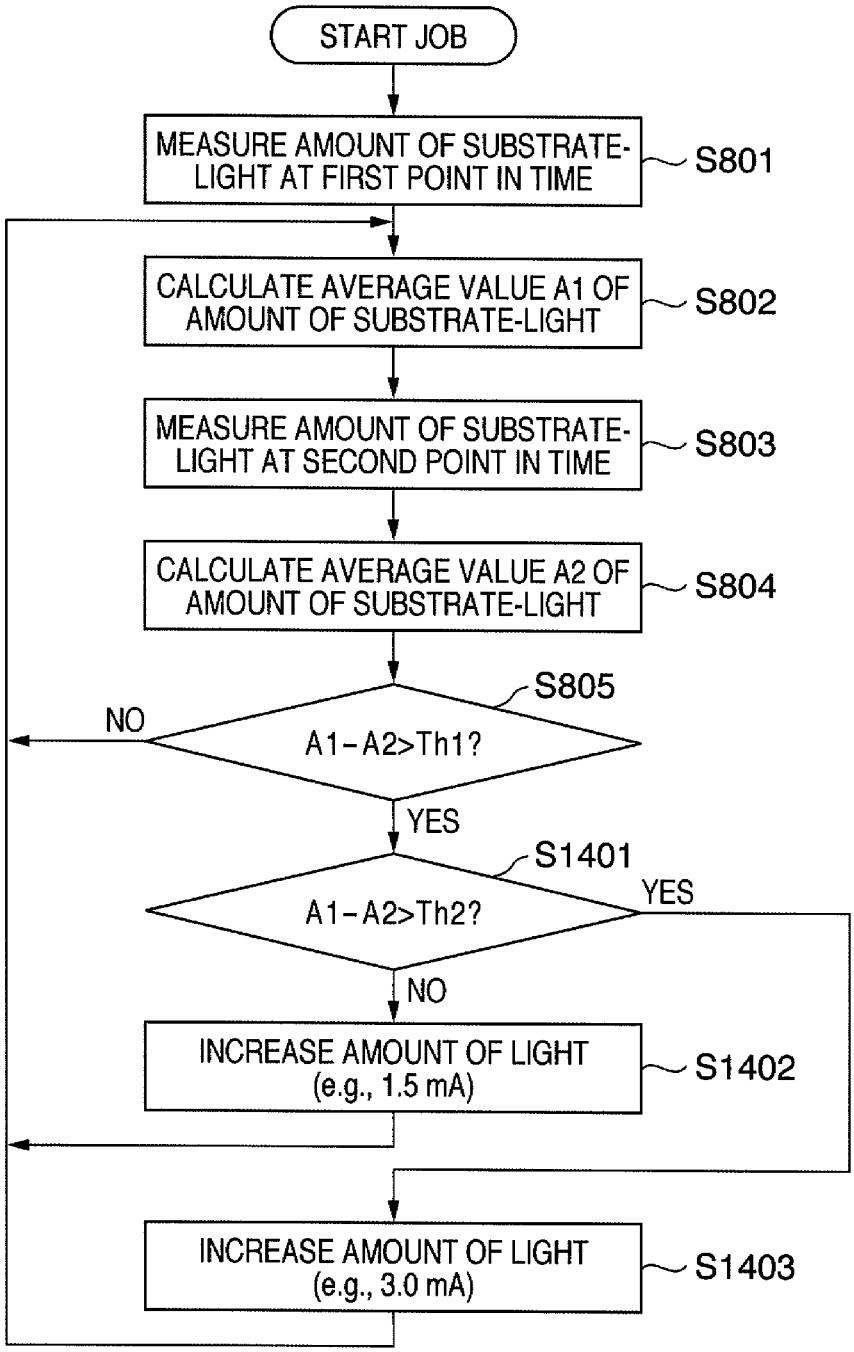
FIG. 14 is a flowchart illustrating an example of a sequence for increasing amount of light implemented during execution of a print job according to a fifth embodiment.

FIG. 14 is a flowchart illustrating an example of a sequence for increasing amount of light implemented during execution of a print job according to a fifth embodiment. Steps and components already described are identified by like reference characters. It will be understood from a comparison with FIG. 8 that steps S805 and S806 have been replaced by steps S1401 to S1403.

If it is determined at step S805 that the above-mentioned difference (A1-A2) is greater than a first threshold value Th1 (e.g., 0.1 V), control proceeds to step S1401. Here the CPU 400 determines whether this difference is greater than a second threshold value Th2 (e.g., 0.2 V). It goes without saying that the second threshold value Th2 is greater than the first threshold value Th1.

If the difference is not greater than the second threshold value Th2, then control proceeds to step S1402, where the CPU 400 increases the amount of emitted light by a first increment (e.g., 1.5 mA). On the other hand, if the difference is greater than the second threshold value Th2, then control proceeds to step S1403, where the CPU 400 increases the amount of emitted light by a second increment (e.g., 3.0 mA) greater than the first increment.

Thus, in accordance with the fifth embodiment, the increment is decided by the CPU 400 in accordance with the size of the difference. Accordingly, this embodiment provides an additional effect, namely finer control than can be achieved with the foregoing embodiments.

Although the fifth embodiment has been described with the first embodiment as the base, it goes without saying that the fifth embodiment is also applicable to the second to fourth embodiments. That is, in relation to the second embodiment, step S906 is replaced by steps S1401 to S1403. In relation to the third embodiment, step S1106 is replaced by steps S1401 to S1403. In relation to the fourth embodiment, step S806 is replaced by steps S1401 to S1403. It goes without saying that the subject of comparison at step S1401 is replaced by what has been described in detail in each of the foregoing embodiments.

Although two threshold values are used in the fifth embodiment, naturally the increment may be changed more finely using three or more threshold values. Ultimately, the CPU 400 may decide the increment dynamically from a numerical formula or the like representing the relationship between the difference and the increment. Thus, the CPU 400 is one example of a deciding unit for deciding the increment in the amount of light in the light-emitting unit in accordance with the difference.

[Other Embodiments]

In the foregoing embodiments, it has been described that one amount of substrate-light, amount of image-light and length of time are detected or measured for every single image. However, a plurality of substrate amounts of light, amounts of image-light and lengths of time may be detected or measured for every single image and the plurality of values obtained may be averaged. There are occasions where the substrate of the transfer belt 8 becomes partially contaminated. If averaging is employed, the effects of noise removal and measurement error can be mitigated.

Figure 15:
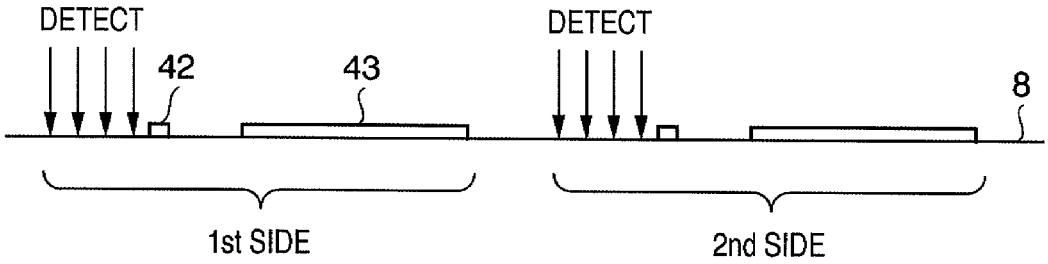
FIG. 15 is a diagram useful in describing an averaging concept.
Figure 16:
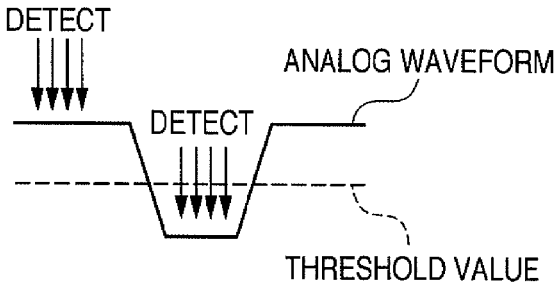
FIG. 16 is a diagram useful in describing an averaging concept.
Figures 17A, 17B, 17C:
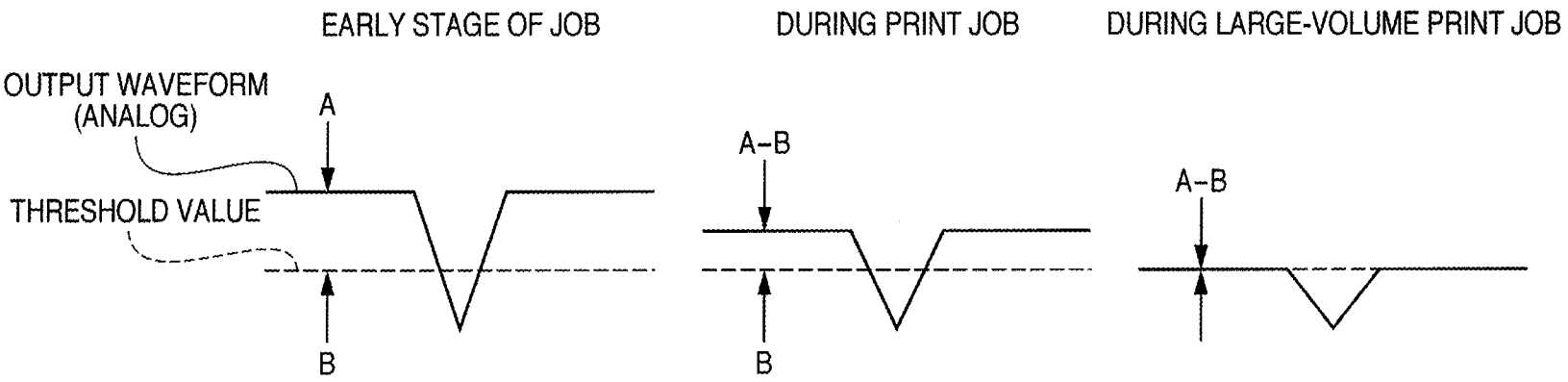
FIG. 17A PRIOR ART
FIG. 17B PRIOR ART
FIG. 17C PRIOR ART
FIGS. 17A to 17C are diagrams illustrating the transition of a difference between an amount of light reflected from the substrate and an amount of light reflected from a toner pattern in a print job involving a large volume of printing.

FIGS. 15 and 16 are diagrams useful in describing the concept of averaging. FIG. 15 illustrates that with regard to amount of substrate-light, sampling is performed a plurality of times (n times) by detection processing executed one time. FIG. 16 illustrates that with regard to amount of substrate-light and amount of image-light, sampling is performed a plurality of times (n times) by detection processing executed one time. An average value may be calculated using all of the n samples or using some of the samples. For example, the CPU 400 may average n−2 samples obtained by eliminating the maximum and minimum values from all n samples, and may adopt the average as the detected value of detection processing executed one time. It goes without saying that such averaging processing can be employed in adjustment of amount of light at the initial stage and not just in the sequence for increasing the amount of light in a large-volume print job.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus that forms a toner image and a pattern image for indicating a position of the toner image on an image carrier, and transfers the toner image on the image carrier to a printing medium, the apparatus comprising:

a light-emitting unit that emits light for irradiating to the image carrier;

a light receiving unit that receives light, and outputs a signal according to an amount of received light;

a conveyance unit that transports the printing medium;

a conveyance control unit that controls the conveyance unit so that the toner image is transferred to a predetermined position of the printing medium, based on the signal outputted by the light receiving unit;

a determination unit that determines a reduction of an amount of light reflected by the image carrier based on the signal outputted from the light receiving unit when the light receiving unit receives the light reflected by the image carrier, while said image forming apparatus is sequentially forming a plurality of toner images and a plurality of pattern images on the image carrier; and a light-power control unit that increases a light amount of the light emitted from the light-emitting unit in accordance with the determination result of the determination unit while said image forming apparatus is sequentially forming the plurality of toner images and the plurality of pattern images on the image carrier.

2. The image forming apparatus according to claim 1, wherein said determination unit determines the reduction of the amount of the light reflected by the image carrier based on an average value of a plurality of signals outputted by the light receiving unit during a time period when the light receiving unit receives the light reflected by the image carrier.

3. The image forming apparatus according to claim 1, wherein said determination unit determines the reduction of the amount of the light reflected by the image carrier based on a first signal and a second signal outputted from the light receiving unit, wherein the first signal is outputted by the light receiving unit at a first timing when the light receiving unit receives the light reflected by the image carrier, wherein the second signal is outputted by the light receiving unit at a second timing when the light receiving unit receives the light reflected by the image carrier, and wherein the second timing is after the first timing.

4. The image forming apparatus according to claim 3, wherein said determination unit determines the reduction of the amount of the light reflected by the image carrier based on a difference between the first signal and the second signal outputted from the light receiving unit.

5. The image forming apparatus according to claim 4, wherein said determination unit determines the reduction of the amount of the light reflected by the image carrier in a case where the difference between the first signal and the second signal is beyond a threshold.

6. The image forming apparatus according to claim 3, wherein the second timing is a timing after a number of the toner images formed on the image carrier is beyond a predetermined number.

7. The image forming apparatus according to claim 1, wherein said determination unit determines the reduction of the amount of the light reflected by the image carrier based on a first signal and a second signal outputted from the light receiving unit, wherein the first signal is an average value of a plurality of signals outputted by the light receiving unit during a first time period when the light receiving unit receives the light reflected by the image carrier, wherein the second signal is an average value of a plurality of signals outputted by the light receiving unit during a second time period when the light receiving unit receives the light reflected by the image carrier, and wherein the second time period is after the first time period.

8. The image forming apparatus according to claim 7, wherein the first time period is a time period from (i) a time when said image forming apparatus starts forming the pattern image on the image carrier to (ii) a time when said image forming apparatus finishes forming a predetermined number of toner images on the image carrier.

9. The image forming apparatus according to claim 7, wherein the second time period is a time period after a number of the toner images formed on the image carrier is beyond a predetermined number.

10. The image forming apparatus according to claim 1, further comprising:

an identifying unit that identifies light reflected by the pattern image based on the signal outputted by the light receiving unit, wherein the conveyance control unit controls the conveyance unit in accordance with an identified timing when said identifying unit identifies the light reflected by the pattern image based on the signal outputted by the light receiving unit.

11. The image forming apparatus according to claim 10, further comprising a detection unit that detects that the printing medium reaches a predetermined location in a conveyance path, wherein the conveyance control unit controls the conveyance unit based on (i) a reached timing when the detection unit detects that the printing medium reaches the predetermined location in the conveyance path, and (ii) the identified timing when said identifying unit identifies the light reflected by the pattern image.

12. The image forming apparatus according to claim 1, wherein the conveyance control unit controls transport speed of the printing medium.

13. The image forming apparatus according to claim 1, wherein the conveyance control unit controls a timing at which conveyance of the printing medium is started.

* * * * *